United States Patent [19]

Rudell et al.

[11] 3,954,129

[45] May 4, 1976

[54] CHRISTMAS TREE WRAP, FLOOR OR RUG PROTECTOR AND DECORATIVE BASE

[76] Inventors: David C. Rudell, 362 S. Creek Drive; Jerry C. Storms, 29 Warsaw St., both of Depew, N.Y. 14043

[22] Filed: Jan. 2, 1974

[21] Appl. No.: 429,939

[52] U.S. Cl. ..... 150/52 R

[51] Int. Cl.[2] ..... B65D 85/70

[58] Field of Search ..... 150/52 R; 47/20, 21, 47/22, 23, 25

[56] References Cited

UNITED STATES PATENTS

| | | | |
|---|---|---|---|
| 1,446,416 | 2/1923 | Curtiss | 150/52 R UX |
| 2,748,516 | 6/1956 | McClusky | 150/52 R UX |
| 2,781,811 | 2/1957 | Dilar | 150/52 R |
| 2,868,255 | 1/1959 | Fancher | 150/52 R |
| 2,911,025 | 11/1959 | Paros | 150/52 R |
| 3,490,469 | 1/1970 | Dubinsky | 150/52 R X |
| 3,729,039 | 4/1973 | Walsh | 150/52 R |
| 3,750,731 | 8/1973 | Brimmell | 150/52 R |

*Primary Examiner*—Donald F. Norton
*Attorney, Agent, or Firm*—Raymond F. Kramer

[57] ABSTRACT

A Christmas tree wrap, also suitable for use during display of the tree as a decorative base and a floor or rug protector under it, comprises a substantially cylindrical wrapper which is open ended at the top thereof and has a bottom with a central opening which is narrower than the top opening. The bottom is adapted to cover a rug or floor and a supporting stand for the Christmas tree, and to be fastened to the tree trunk above the stand.

In preferred embodiments of the invention the Christmas tree wrap will be made of 2 to 6 mil polymeric film, will be opaque and/or decorated, will have a central portion of the base which will lie flat or extend downwardly substantially conically from the Christmas tree trunk and will include a separated cylindrical wall portion near the top of the wrap to facilitate initial enclosing of the lower branches of a tree as wrapping is begun and fastening means for holding said separated walls together after they have been drawn up about the lower branches.

10 Claims, 7 Drawing Figures

CHRISTMAS TREE WRAP, FLOOR OR RUG PROTECTOR AND DECORATIVE BASE

This invention relates to a Christmas tree wrap which is also useful as a floor or rug protector and a decorative base during display of the tree. More particularly, it is of such a wrap constructed of a polymeric film material of a size and described shape adapted to enclose a tree so as to facilitate transportation of it without dropping of needles, which wrap may also be usefully "stored" underneath the tree while the tree is on display and serves as a needle catcher. Particular advantages of the invented article are: (1) attractiveness during display of the tree; (2) decorative and utilitarian aspects during "storage" (it can have decorative scenes or designs on the base and cylindrical walls and these can cooperate to hold water, Christmas snow, Nativity scenes, Santa Claus displays, etc.); (3) needle catching and retaining and floor and rug protecting actions; and (4) ready wrapping and unwrapping of the tree without needle loss.

The problem of transporting Christmas trees without causing losses of needles, especially when the trees have become dried out after completion of use or display, is well-known and in the past has been accepted as an unpleasant but necessary accompaniment of the use and display of natural Christmas trees indoors. Needles dropping during display of the tree could make unattractive Nativity or other scenes created under the tree. Also, dripping of exuded resins or gums from the tree can permanently damage rugs, carpeting or floors. It has been the practice to protect such supporting surfaces by covering them with newspapers, cloths and absorbent cotton batts. While these have performed very useful protective and sometimes decorative functions, they are not usually waterproof, sometimes allow material to pass through them and of course, do not prevent needles from dropping onto rugs, carpets and floors, etc., during transport of the tree.

The problem of packaging Christmas trees and various solutions to it are illustrated in U.S. Pat. Nos. 2,847,805; 2,934,204; and 3,249,140. A Christmas tree mat which acts as a needle catcher is described in U.S. Pat. No. 2,748,516. However, only in U.S. Pat. Nos. 2,781,811 and 2,911,025, as far as applicants know, have there been described combination Christmas tree wrappers or covers and ground sheets or needle catchers. The devices illustrated are much more complex than those of the present invention and would be more costly to manufacture, limiting their utilities.

In accordance with the present invention there is provided a Christmas tree wrap, floor or rug protector and decorative base suitable for use in conjunction with the display of a Christmas tree as a base under the tree, protecting a floor or rug under it and preventing needles or other materials falling from the tree from contacting such floor or rug, and adapted to cover or wrap the tree when it is to be moved, preventing the dropping of needles on floors and rugs, which comprises a substantially cylindrical wrapper having a top of the cylinder which is open and as wide as or wider than the width at any other height thereof, and a bottom with a central opening therein narrower than the top opening, said bottom being adapted to cover a rug or floor and a supporting stand for the Christmas tree and to be fastened to the tree trunk above the stand. In preferred embodiments the material of the wrap is a polymeric film which is 2 to 6 mils thick, preferably 2 to 4 mil polyethylene. Such film may be opaque and may include specific designs, decorations or illustrations. It may be of such a cut so that the walls thereof are cylindrical and of a diameter as great as the maximum tree diameter, with a bottom portion that is adapted to be fastened to the tree trunk. Zippers or other fasteners may be employed to close and/or hold together separated upper cylindrical wall portions of the wrap to facilitate initial enclosing of the lower branches of a Christmas tree as wrapping is begun. Also, a specific attractive appearance of the circumferential wall of the wrapper-floor protector during display "storage" is obtained by utilizing an accordion fold over the length of the wrapper cylinder or a substantial part thereof, e.g., 50 – 95%.

The invention will be readily understood by reference to the drawing and the accompanying description.

Figure 1:
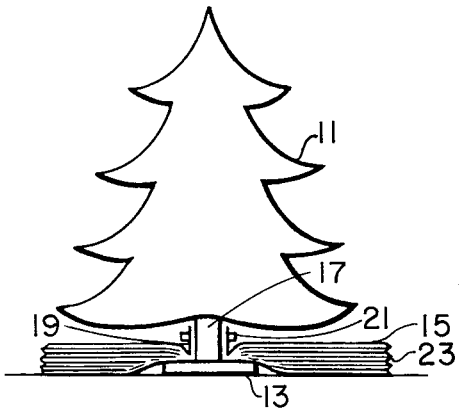
FIG. 1 is a partially cutaway elevation of a Christmas tree on a stand with a decorative base of this invention in position above the stand and below the tree, tied to the tree trunk and protecting the floor or rug under it from needles or other materials which may fall from the tree.

In FIG. 1 numeral 11 represents a Christmas tree, usually of such a type as tends to shed needles readily, especially when dried out or subjected to rough handling. Tree 11 is supported by a conventional flat wooden base 13, to which it may be nailed. The Christmas tree wrap, floor or rug protector and decorative base and needle catcher 15 is positioned about tree trunk 17 and above stand 13, with the collar portion 19 of the wrap being held to trunk 17 by tie 21 tightly fastened about the trunk. In the position illustrated the bottomed, cylindrical wrap 15 has a side wall 23 thereof folded down, forming a circular enclosure or reservoir about the tree, suitable for use as a decorative base, on which bottom, if desired, Christmas snow, artificial grass, a Nativity scene, a Santa Claus display, farm or city scenes, or even water, possibly with toy boats, swans or other toy aquatic birds or fishes, may be present.

Figure 2:
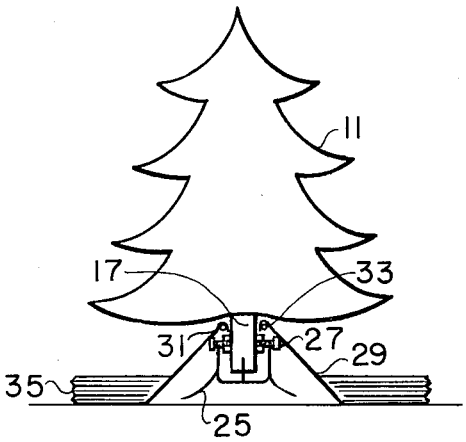
FIG. 2 is a similar view of another embodiment of the invention fastened in a preferred manner to the tree.

In FIG. 2 is illustrated tree 11 having a different design of the Christmas tree wrap and floor rug protector of the present invention attached to it and stored beneath it. Tree stand 25 is held to trunk 17 by screws 27. Above stand 25 wrapper-protector 29 is fastened at neck or collar portion 31 thereof by tie 33. It extends downwardly therefrom over the treestand. If desired, a conical shield, not illustrated, may be positioned over the stand to protect the wrap against being pierced by stand parts. This is especially desirable if the wrap unit, during display of the tree, is to contain water. Sides 35 of wrap 29 are folded in irregular folds, resulting in a light-reflecting wall of attractive appearance about the base of the tree.

Figure 3:
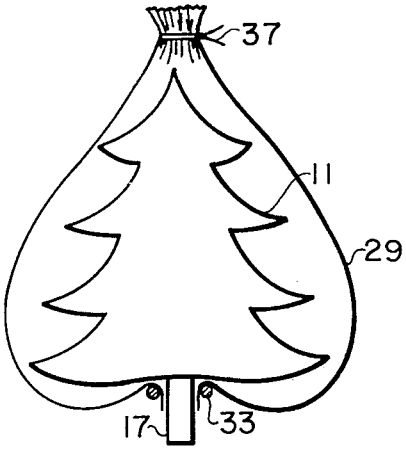
FIG. 3 is an elevational view of the article of FIG. 2 wrapped about the tree and tied to prepare the tree for transportation or storage without objectionable dropping of needles below the tree.

FIG. 3 illustrates the tree 11 wrapped in a wrapper 29 of the type shown in FIG. 2. Tie 33 is employed to hold the neck of the bottom portion of the wrapper about the tree trunk 17 and another tie 37 holds the top of the cylindrical wrapper closed tightly about the tree. As illustrated, the tree is somewhat loosely held within the wrapper 29 but the wrapper may be more tightly drawn and tied to force the branches of the tree upwardly so that the diameter thereof will be reduced and movements through doorways and narrow openings will be facilitated.

Figure 4:
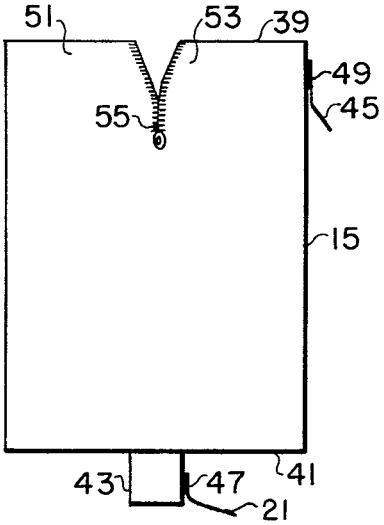
FIG. 4 is a vertical elevational view of the wrap of FIG. 1 in vertical opening position.

In FIG. 4 the wrapper 15 of FIG. 1 is shown in open and extended position. In the illustration the wrapper is essentially cylindrical and has an open top portion 39 and a flat bottom 41 having a tubular or neck portion 43 of lesser diameter adapted for fastening about a tree trunk. Ties 21 and 45 are shown fastened in place on the wrapper at 47 and 49, respectively. The upper section of the cylinder at 51 and 53 is separated so as to facilitate initial drawing of the wrapper up over the bottom branches of the Christmas tree, when enclosing the tree. As illustrated, the fastening means (and the separating means) is a zipper 55 but other fastening means such as snaps, laces, hooks and eyes, Velcro fasteners and ties may also be employed. The separation may extend for the entire length of the wrap but this is not considered to be preferable and usually the separation and the fastening means extend over a length from the top of the wrap of about 10 –30% thereof.

Figure 5:
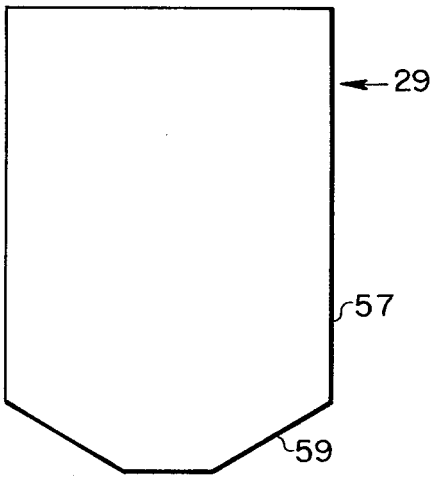
FIG. 5 is a vertical elevational view of the wrap of FIG. 2 in vertical open position.

In FIG. 5 the wrapper 29 of FIG. 2 is shown. It will be noted that it has a cylindrical side wall 57 and a frustoconical or truncated cone bottom portion 59, which serves to produce the desired slope, covering the treestand 25 during display.

Figure 7:
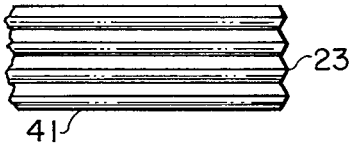
FIG. 7 is an elevational view of a part of a side of wrap, during storage under the tree, illustrating accordion folds thereof.
Figure 6:
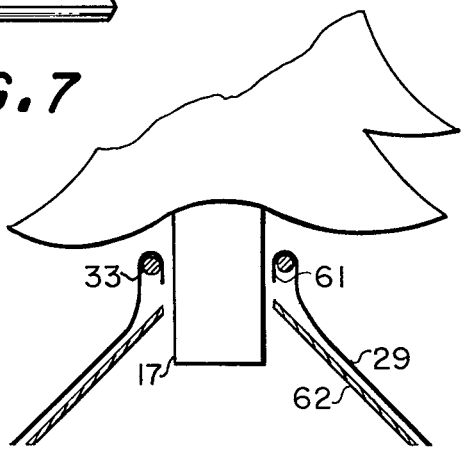
FIG. 6 is an enlarged partially sectional elevational view of a bottom portion of the wrap held to the Christmas tree trunk by a preferred tie.

FIG. 6 is an enlargement of a portion of FIG. 2 and the desirable fastening of the wrap 29 to tree trunk 17 is shown clearly. As will be noted, a portion 61 of the wrap is positioned with the open end thereof facing downwardly and tie 33 is tied about the trunk, holding the portion 61 against it. Then the remainder of the open end of the wrap is inclined downwardly, for display use. Such affixation, which is preferred, has the advantage of allowing easy removal of tie 33 from the tree after the tree has been wrapped and causes a binding or snubbing effect of the wrap about the tie as strain is placed on the bottom of the wrap, when on display, as by filling it with water or placing display items on it. Frustoconical shield 62 protects the wrap 29 against accidental piercing by parts of the Christmas tree stand. In FIG. 7, the cylindrical side wall of the wrap is precreased in accordion folds so as to facilitate compact folding of the sides into an orderly configuration during display use and to diminish the total height thereof. Such folds also have the advantage of helping to "rigidify" the side walls, as when water is contained in the wrap while it is on display, and minimize the possibility of leakage since the pressure of the water tends to open the accordion folds at the bottom and move the wall upwardly, keeping it above the water level.

The shape of the present Christmas tree wrap is essentially cylindrical and it is desirable for the upper opening thereof to be as wide as or wider than the width at any other height of the cylinder. The cylinder may be made from a sheet material which is fused or welded at the seams or it may be drawn as one piece. The bottom, collar and neck portions of such cylinders may be cut out separately and may be joined by any suitable means, preferably solvent or melt fusion. Then, in some preferred embodiments of the invention, the cylinders may be folded in accordion folds so as to compact them and make them more readily shippable. However, when desired, they may be folded in a more random fashion to obtain special irregular creasing effects which may sometimes be considered more attractive than regular pleats or folds. If desired, other shapes than cylindrical may be used but these are not generally preferred since they usually involve additional material, at additional expense, take up more floor room and are more difficult to fold neatly. However, polygonal and curved tubular shapes are feasible.

The material of the wrappers may be any of various suitable available film or sheet materials, which include natural and synthetic rubbers, cloths and strengthened, treated papers, but the waterproof, strong, synthetic organic polymers or plastics, such as polyethylene, polyvinyl chloride, polypropylene, Mylar and polyvinylidene chloride are preferred. Such materials and other plastic films useful in heavy duty applications, e.g., trash bags, garbage can liners, tenting, pool liners, are most satisfactory in the present applications. They will usually be of a thickness of 2 to 6 mils, preferably of 2 to 4 mils and most preferably about 3 mils, for desirable strength and yet, will be of sufficient economy so that throwaway wrappers may be employed, if desired.

The two most highly preferred embodiments of the invention are an open top cylinder having a frustoconical bottom and an open top cylinder having a flat bottom with a central opening and an upwardly extending (in display use) tubular section about such opening, adapted to be fastened to the Christmas tree trunk. In both of these designs, separated cylindrical wall portions near the top may be employed so as to facilitate initial end closing of the lower branches of the Christmas tree as the wrapping of the tree is begun and with the separable portions there may also be utilized fastening means for holding the walls together after they have been drawn up about the lower branches of the tree.

The material of construction of the wrapper may be transparent, translucent or opaque and may be dyed or pigmented in any of various colors or in designs. Specifically, it may be printed with Christmas tree, Santa Claus or other images or designs, may be colored green, blue or white to simulate grass, water or snow and may have different scenes imprinted on it. The topmost portion of the cylinder may be thickened or reinforced to help rigidify it and hold it in place during display of the Christmas tree with the wrapper-protector underneath it. The ties employed may be twist-hold paper-covered or plastic-covered wires or strips, elastic bands, wires, cords, clamps or other substitutes, providing only that they satisfactorily hold the wrapper in desired position.

The sizes of the wrappers may be chosen to fit various trees for which they are intended. Normally, for a large tree, the cylinder portion will be approximately 8 feet high by 5 feet in diameter.

The present invention may be employed from the moment of purchase of the tree until discarding thereof. The newly bought tree may be wrapped in the wrapper and tied so as to prevent moisture loss. It may even be stored in wrapped form awaiting sale. Some water may be intentionally sprayed onto the tree branches before wrapping or may be deposited in the interior of the wrap before sealing thereof so as to maintain the freshness of the tree until it is ready to be installed. In such cases the tree may be stored in the wrap, often for several days or weeks, and then may be brought into the house for display, after removal of excess water. The treestand is fastened to the tree and the wrap is removed. Any needles that might have fallen from the branches during transportation of the tree are held within the wrap, usually at the bottom thereof, and may be readily drawn to one side thereof and removed. The wrap is then placed in display position and water, representational objects or other ornaments are placed in it or on it, usually after the tree is decorated. Fallen needles or other objects may be easily removed before final preparation or decoration of the wrap base.

After completion of the display of the Christmas tree the ornaments are removed from it, with the rug and floor protector in place, and the wrapper is then drawn up over the tree, preferably with the upper separable portions of the cylinder being initially spread apart so as to facilitate enclosing of the branches without causing needle fall beyond the wrap-protected area of the floor or carpet. The wrapper is then tied in place at the top of the tree, as well as the bottom, and if desired, extra force is applied to bend the branches inwardly to diminish the tree diameter and facilitate passages through narrow doorways. It is desirable that during the transporting of the tree it be maintained substantially horizontal so as to prevent any sifting of needles or other items out of the wrap or, if it is held vertical, there should be maintained a slight slag or belly in it to hold needles and keep them from sifting out past the tie about the tree trunk.

If it is made of a comparatively thin and inexpensive plastic, such as 2 or 3 mil polyethylene, the wrapper may be discarded with the tree. If such single use is uneconomical, the wrapper may be removed by untying the ties (if the wrapper is to be reused the method of tying illustrated in FIGS. 2 and 6 will normally be employed) and the wrapper will be collapsed or folded to display position, after which it can be additionally folded to suit it for storage until the following Christmas.

Most of the advantages of the present invention are apparent from the previous description. Additionally, however, it may be mentioned that use of the wrapper as a floor protector or decorative base under the tree while the tree is displayed can lengthen the tree life and prevent needle drop if the base is filled with water, thereby providing a humid atmosphere about the tree (in addition to the water provided by the treestand to be drawn up into the tree by capillary action). Thus, needle fall is inhibited and the few needles that do fall are caught in the water on the base, from which they are readily removable, and are prevented from damaging the carpet or floor under it.

The invention has been described with respect to preferred embodiments of it but is not to be limited to these because it is apparent that one of ordinary skill in the art with the present description before him will be able to utilize substitutes and equivalents without departing from the spirit of the invention or going outside the scope of the claims.

What is claimed is:

1. A wrapped Christmas tree comprising a Christmas tree of a type which sheds needles when dried out or subjected to rough handling and a Christmas tree wrap about the tree which also functions as a floor or rug protector and decorative base suitable for use in conjunction with display of the Christmas tree, protecting a floor or rug under it and preventing needles or other materials from the tree from contacting such floor or rug and which is adapted to cover or wrap the tree when it is to be moved, preventing the dropping of needles on floors or rugs during said moving or preparation therefor, said wrap being of a synthetic organic polymeric material which, before it is wrapped about the Christmas tree, has a cylindrical upper section and a truncated, conical lower section, with the top of the cylinder, corresponding in position to the top portion of the wrapped tree, being open, and with the lower part of the truncated conical section, corresponding to the bottom portion of the wrapped tree, having a central opening narrower than the cylinder opening, said lower portion being adapted to cover a rug or floor and a supporting stand for the Christmas tree, said bottom being adapted to be fastened near the opening therein to the tree trunk above the stand during display of the tree and said bottom being fastened near the opening therein to said tree trunk near the bottom of the tree.

2. A wrapped Christmas tree according to claim 1 wherein the wrap, before wrapping about the tree, includes separated wall portions of the cylindrical wrap section corresponding to the top of the tree to facilitate initial enclosing of the lower branches of the tree as wrapping thereof is begun, and fastening means holding said separated wall portions together after they have been drawn up about said lower branches, and holding the separated wrap walls together about the tree.

3. A wrapped Christmas tree according to claim 1 wherein the cylindrical wall is of accordion folds which are operable when the wrap is fastened about the tree and are capable of forming compactly folded cylindrical sides when the wrap is in position under a displayed tree as a floor or rug protector and decorative base.

4. A wrapped Christmas tree according to claim 1 wherein the polymeric material is a film of a thickness in the range of 2 to 6 mils.

5. A wrapped Christmas tree according to claim 4 wherein the polymeric film material is selected from the group consisting of polyethylene, polyvinyl chloride, polypropylene, Mylar and polyvinylidene chloride.

6. A wrapped Christmas tree according to claim 5 wherein the polymeric material is polyethylene and the film is of a thickness in the range of 2 to 4 mils.

7. A Christmas tree wrap which also functions as a floor or rug protector and decorative base suitable for use in conjunction with display of the Christmas tree, protecting a floor or rug under it and preventing needles or other materials from the tree from contacting such floor or rug and being adapted to cover or wrap the tree when it is to be moved, preventing the dropping of needles on floors or rugs during said moving or preparation therefor, comprising a synthetic organic polymeric material which, before being employed as a floor or rug protector and decorative base, and before wrapping about a Christmas tree, has the form of an upper cylindrical section connecting to a lower truncated conical section, with the top of the cylinder, corresponding in position to the top portion of the tree to be wrapped, being open, and with the bottom of the truncated, conical lower section, corresponding to the bottom portion of the tree to be wrapped, having a central opening narrower than the cylinder opening, said lower section being adapted to cover a rug or floor and a supporting stand for the Christmas tree and said bottom being adapted to be fastened near the opening therein to the tree trunk above the stand during display of the tree.

8. A Christmas tree wrap according to claim 7 wherein the polymeric material is selected from the group consisting of polyethylene, polyvinyl chloride, polypropylene, Mylar and polyvinylidene chloride and is in the form of a film of a thickness in the range of 2 to 6 mils.

9. A Christmas tree wrap according to claim 8 wherein the polymeric material is polyethylene and the film is of a thickness in the range of 2 to 4 mils.

10. A Christmas tree wrap according to claim 7 wherein the cylindrical wall is of accordion folds which are openable when the wrap is fastened about the tree and are capable of forming compactly folded cylindrical sides when the wrap is in position under a displayed tree as a floor or rug protector and decorative base.

* * * * *